US009803908B2

(12) United States Patent
Estrada Amo

(10) Patent No.: US 9,803,908 B2
(45) Date of Patent: Oct. 31, 2017

(54) RAPID FREEZING OF ICE CUBES COMPRISING METHOD, DEVICE, PRODUCT AND USES

(71) Applicant: New Ices Technologies, Sociedad Limitada, Seville (ES)

(72) Inventor: Manuel Estrada Amo, Seville (ES)

(73) Assignee: New Ices Technologies, Sociedad Limitada, Seville (ES)

( * ) Notice: Subject to any disclaimer, the term of this patent is extended or adjusted under 35 U.S.C. 154(b) by 303 days.

(21) Appl. No.: 14/432,346

(22) PCT Filed: Sep. 26, 2013

(86) PCT No.: PCT/ES2013/000210
§ 371 (c)(1),
(2) Date: Mar. 30, 2015

(87) PCT Pub. No.: WO2014/049179
PCT Pub. Date: Apr. 3, 2014

(65) Prior Publication Data

US 2015/0276294 A1 Oct. 1, 2015

(30) Foreign Application Priority Data

Sep. 28, 2012 (ES) ..... 201200952

(51) Int. Cl.
*F25C 5/08* (2006.01)
*F25C 1/04* (2006.01)

(52) U.S. Cl.
CPC ..... *F25C 5/08* (2013.01); *F25C 1/04* (2013.01); *F25C 2600/04* (2013.01); *F25C 2700/14* (2013.01)

(58) Field of Classification Search
CPC ..... F25C 5/08; F25C 1/04; F25C 2700/14; F25C 2600/04; A61F 7/02; H02K 41/00
See application file for complete search history.

(56) References Cited

U.S. PATENT DOCUMENTS 3,254,501 A 6/1966 Brysselbout
4,356,708 A * 11/1982 Horton ..... F25D 11/006 62/430

(Continued)

FOREIGN PATENT DOCUMENTS

| | | |
|---|---|---|
| ES | 2199672 | 2/2004 |
| GB | 2340921 | 3/2000 |
| WO | WO 2014/049179 | 4/2014 |

OTHER PUBLICATIONS

International Search Report dated Feb. 27, 2014 From the Oficina Espanol de Patentes y Marcas Re. Application No. PCT/ES2013/000210 and Its Translation Into English.

*Primary Examiner* — Emmanuel Duke

(57) ABSTRACT

The invention relates to a method for rapid freezing of ice cubes by means of a higher dispensing rate and contact freezing, the cube being produced in 7 minutes with a water consumption equivalent to the volume of the cubes, thereby not wasting a single drop of water. A conventional condenser and compressor store cold in a store where the cold produced is maintained at a constant temperature of −30° C., and a gel that absorbs the cold from the medium is pumped as far as the ice-tray, where it runs into the spaces separating the cells where the cubes are formed in order then to return via a downward conduit to the cold store, continuing the cycle, and a series of dispensing devices meter out the water necessary into the cells where a contact-freezing process is initiated.

13 Claims, 1 Drawing Sheet

(56) References Cited

U.S. PATENT DOCUMENTS

| | | | | |
|---|---|---|---|---|
| 4,909,039 | A | 3/1990 | Yamada et al. | |
| 2005/0057102 | A1* | 3/2005 | Totsu ..... | G03F 7/70758 310/12.06 |

* cited by examiner

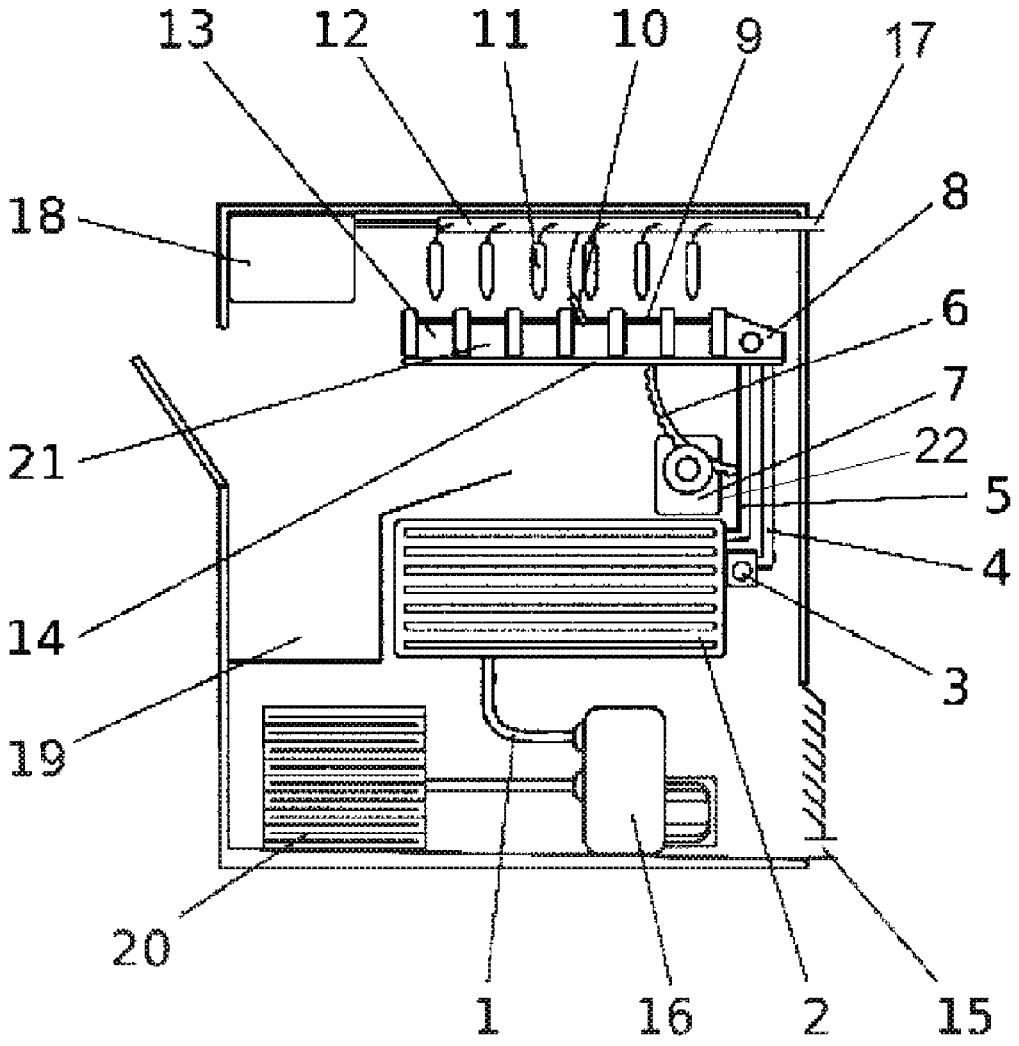
13
12
11
10
9
17
18
8
6
7
22
5
4
3
21
14
19
20
1
16
2
15

RAPID FREEZING OF ICE CUBES COMPRISING METHOD, DEVICE, PRODUCT AND USES

RELATED APPLICATIONS

This application is a National Phase of PCT Patent Application No. PCT/ES2013/000210 having International filing date of Sep. 26, 2013, which claims the benefit of priority of Spanish Patent Application No. P201200952 filed on Sep. 28, 2012. The contents of the above applications are all incorporated by reference as if fully set forth herein in their entirety.

OBJECT OF THE INVENTION

The present invention relates to a novel method for rapid freezing of ice cubes and an innovative device for implementing said method, also comprising the advantageous product obtained as well as the different uses to which the product can be destined.

The device for rapid freezing ice cubes, object of this invention, has been developed to produce cubes by means of a higher dosing rate and contact freezing, the cube being produced in 7 minutes with a water consumption equivalent to the volume of the cubes, thereby not wasting a single drop of water.

In this technical field, those effective developments specifically dedicated to rapid freezing of ice cubes with maximum water saving leading to a system of efficient use, low cost, simplicity and yielding technically and economically significant results predominates. The characteristics of the proposed invention advantageously overcome this concept, by providing to the state of the art one embodiment hitherto unknown, since for the first time a single drop of water is not wasted or recycled, therefore, not being necessary a connection to a drainage system and thus being of simpler and more economical installation, with the possibility of placing the device anywhere.

The main problem that it solves is the saving of 100% in the consumption of water compared to the waste that occurs with the devices of the state of the art, where despite the efforts to reduce such consumption this is estimated between 400 and 220 kg/day for each machine for rapid freezing of ice cubes. This is due to the fact that the method known so far forces micronized water continuously through cooled cells in which the ice cube is formed, so that part of that water adheres to the colder surfaces and stays there already converted into ice, but much of that same water, which does not transform into ice is irredeemably lost, going into the sewer system. Instead, the present invention uses only the water required for the freezing of each cube, as will be explained later in the description of the invention.

This total saving in water consumption entails many advantages, the first one being the drastic reduction of water that remains limited to that strictly necessary for dose filling the ice trays with the consequent energy saving, since running the water, or recycling it, or draining it are not required. It is known that water is a precious element that should not be squandered and hence the ecological advantage of this invention, but also in this case saving in the maintenance of machinery is also advantageously achieved, since it does not require ducts and sprinkler heads that tend to lose effectiveness and even to become obstructed because of the mineral content, sometimes limestone, in many waters, especially in urban environments where the rapid freezing of ice cube machines known so far are used.

Another advantage is the gain of useful space because of the absence of said ducts and sprinklers or nebulizers, resulting therefore in a smaller device. Another advantage is that for its installation a drain pipe is not necessary, so it can be placed wherever is most suitable. It also must be emphasized as an advantage the hygiene it entails due to the possibility of using mineral water or water specifically treated for the production of quality ice cubes, since it only requires the necessary water to fill the ice tray. Another advantage is the low energy consumption, especially noticeable in the field of hospitality and even the domestic use of these rapid ice cube freezers.

BACKGROUND OF THE INVENTION

While no invention similar to that herein proposed is known in the prior art, documents showing the state of the art related to the same are mentioned below.

Thus, document ES 2 063 070 T3 refers to an automatic device to make ice cubes, which includes a support frame for a plurality of aligned cups associated with an evaporator and arranged opposite to means for spraying water that will freeze, compression and condensation means, means associated to reverse the refrigeration cycle to separate the cubes from the cups, controlling means to vary the refrigeration time of the water suitable to form these cubes and the defrosting time of these cubes to separate them from the cups, said control means comprising, at least, one first probe to measure the temperature of the environment and/or of the output of such condensation means and, at least, one second probe to measure the temperature of the water entering the appliance, characterised in that such controlling means include, at least, one electronic board that contains a microcomputer which comprises at least two optical probes coaxially arranged on opposite sides with respect to, at least, one cup that has, proximate to each of these optical probes, at least two portions made of a transparent material.

To obtain ice cubes in public hospitality establishments, machines of small size, requiring about 2 liters of water to obtain 250 $cm^3$ of ice are used, wherein the wasted water passes directly to the water drainage system. This implies, on the one hand, a remarkable waste of water, which can reach 80%, and on the other, an energy waste, since what is lost is cold water at a temperature of about 8° C. Hence, the utility model ES 1 022 297 U proposes an economizer, attachable to an ice cube maker machine to solve such a problem. To do this, the economizer consists of an auxiliary tank to which water usually discarded arrives through a filter, and from there, it is sent back to the ice cube maker machine, by means of a pump, at a relatively low temperature, in the order of the 8° C., which represents a considerably lower energy consumption, while the operational cadence of the same is greatly accentuated because the thermal difference which must be produced in said machine is substantially smaller, to the point that the approximately 16 minutes usually taken by an operating cycle of a conventional ice cube maker machine become ten minutes when the economizer of the invention is coupled to said machine.

Also the utility model ES 1 022 297 U proposes an economizer adaptable to ice cube maker machines, which comprises a reservoir, intended to be conveniently attached to the ice cube maker machine, and connected to the latter through an inlet, which corresponds to the discharge outlet of waste water of said ice cube maker machine, this inlet ending in a filter, while in the lower area of said reservoir an outlet is arranged, which, through a forcing pump with appropriate characteristics, is connected to the inlet or feeder of the ice cube maker machine, all so that the waste water of each operating cycle of said machine is reused through the economizer in the following operating cycle thereof.

Likewise, the objective of the document ES 2 199 641 A1 refers to technical improvements in ice cube maker machines ice for saving water, by producing a controlled recycling of the water flowing along the device. To achieve this, a probe or detector of physical variables together with a detector of water presence and an electric pump that pumps water to recycle it for further use in the machine are used.

Also the document DE-C-936042 describes an ice maker machine with an evaporator, a plurality of individual cells forming ice, a water dispenser and a deflector plate to direct the water that enters through the upper end of the ice-forming cell towards an inner surface of the cell, said invention including an evaporator having a plurality of individual ice-forming cells. Each ice-forming cell has a closed perimeter and an opening at a lower end. A water distributor is coupled to the evaporator and is configured to deliver water at or near an upper end of each of the plurality of individual ice-forming cells, so that the water flows down within the perimeter of the individual ice-forming cells. It also includes a water recirculation system including a drain, a water pump located inside the drain, and a water recirculation pipe coupled to the water pump and water dispenser.

Typically, known ice makers produce ice by making water flow on a frozen surface. Usually, the frozen surface is thermally coupled to evaporator coils which are, in turn, coupled to a cooling system. The frozen plate, or the evaporator, contains a number of notches on its surface where the flowing water can accumulate. Typically, the notches are punched holes in a metal plate of high thermal conductivity. As the water flows over the notches, it is frozen into ice. To collect ice, the evaporator is heated by hot steam flowing through the evaporator coils. Once released from the evaporator surface, the ice cubes are made and fall into an ice storage bin. The ice cubes produced by a typical ice maker have a square or rectangular shape and a slightly thin profile. Instead of having a three-dimensional cube shape, they are tile-shaped and are of reduced dimensions. That is, they are different from the ice cubes produced in residential refrigerators which typically have a cube shape and are larger, more suitable for cooling drinks in glasses, and which are usually held by tweezers. Most domestic ice makers, which are included in the refrigerators, freeze standing water resulting in turbid ice, which is less desirable than the clear ice commercially produced. Besides producing small ice cubes, conventional ice makers are typically large and bulky machines requiring a large amount of space. An ice maker for home use, on the other hand, requires a small base and a compact size that can fit under kitchen cabinet countertops typically found in domestic kitchens and must operate using electricity available at household electric current and voltage. Several ice makers have been developed and marketed for the residential market. Typically, these machines do not produce large clear ice cubes. There is one model which produces clear cubes, but uses an evaporator that is not totally reliable because it uses jets of pressurized water which tend to clog, particularly when no routine maintenance, which is absent or, in the best case, is performed infrequently in household ice makers. Therefore, there is a need for a compact ice maker capable of producing clear ice cubes, a machine that is reliable and compatible for both household and commercial use, and that can be constructed at a reasonable cost using automated technology. The present invention fulfils these requirements.

DESCRIPTION OF THE INVENTION

The method of rapid freezing ice cubes object of the present invention proceeds in the following steps:

a) Cold is produced through a conventional condenser and compressor of low power consumption and is brought to an enclosure built in an approved food grade material called cold store, until reaching a temperature of −30° C., by maintaining said temperature constant.

b) By means of a forcing pump, a coolant liquid gel at −30° C. is pumped from a cooling coil located inside of said cold store, through an upward conduit, running into the spaces between the cells where the cubes are formed in the ice-tray, then to return to a downward conduit again to the cooling coil, thus continuing the cycle.

c) The water necessary for refilling each of the cells forming the ice-tray is dispensed through a number of liquid dispensers attached in line to its structural support.

d) A delay of 5 to 10 minute is allowed to lapse, depending on the cube size, until the water contained in each of said cells of highly conductive material freezes through the walls' contact with the gel, with an ice ultrasonic or infrared temperature detector detecting the moment when the ice has reached the set temperature.

e) In that moment, a heater ring, which heats each cube until it can come off the walls of the cell, is activated.

f) At the same time, a lower ice-tray gate swings about a hinge axis through the starting of a gear motor, thereby releasing the base or bottom cover of the cells so far covered by said gate.

g) Upon release of the cell lower cover, the ice cube falls by presenting on its underside a distinctive sign or word initial engraved, which the upper side of said gate presents in bas-relief regularly spaced and coinciding with the base of the cells.

h) Ice cubes slide down the ramp formed by said opened gate to the cube storage bin.

The rapid ice cube freezing device object of the present invention is constituted from a housing that houses at its base a conventional condenser and compressor, and on these, a cold store on the right and an ice cube storage bin on the left, the first consisting of an enclosure made in an approved food grade material where the cold produced is maintained at a constant temperature of −30° C. Within said cold store is a coil, which absorbs the ambient cold being maintained also at a constant temperature of −30° C. A forcing pump pumps the gel through an upward conduct until arriving to the ice-tray, where it runs into the spaces separating the cells in which cubes are formed, and then returns via a downward conduit to the cooling coil continuing the cycle. A number of liquid dispensers attached in line to its structural support meter out the necessary water until reaching the programmed amount of one of the cells that form the ice-tray and, once filled, a freezing process starts by contact of their walls of high conductive material with the cooling gel, the freezing process taking between 5 and 10 minutes, depending on the size of the cube. An ultrasound or infrared temperature detector detects the moment in which the ice cubes reach the set temperature, in which moment a heater ring is activated that heats each frozen cube until it can come off of the walls of the cell and go down when the lower gate of the ice-tray that swings just at that moment about a hinge axis situated at one end of the ice-tray, which is automatically operated by a gear motor. By the swinging of the gate, the cell base remains free.

The top side of this gate may have a bas-relief of distinctive signs at regular spaces matching with the cube base, which may be initials of trademarks or others, which are engraved at the base of the cube. Once opened the gate, the ice cubes fall and slide down the ramp formed by the same opened gate to the cube storage bin.

A PLC controls the operation and maintenance of the device by detecting and controlling lack of water
low temperature at cold store
opening and closing of the ice-tray gate
ice storage bin full
cube finished at the set temperature
failure in the pump for liquids
failure in the gear motor
failure in dosing and dispensing
failure in compressor and evaporator
inlet water temperature
failure in defrosting heaters
power failure alarm
ceasing of the operation at the opening of the housing panels In one mode for carrying out the invention, instead of a cold store, a gas coil is used in the dosing ice-tray.

The ice cube produced by this method and with this rapid freezing device is a product that, unlike those known from the state of the art, has been made without wasting a single drop of water, and therefore with a 100% ice production efficiency, which allows the use of mineral water or water specifically treated for this purpose, or water flavoured with fruit flavours, such as lemon or tropical fruit, or even fruit juices, with the evident impact on the diversity and quality of the cube.

The ice cube can, therefore, be adapted without being a problem to applications that require a quality or certain flavours, such as upscale hospitality, Haute cuisine, ice cream shops along with the common and ordinary use of the ice cube.

BRIEF DESCRIPTION OF THE DRAWINGS

Next, reference is made to figures that help to better understand the description and shows a non-exclusive concrete mode for obtaining an ice cube.

FIG. 1: Side view of the housing showing the elements of the device that do not characterise the invention In said figures, the following numbered elements stand out:

1.—Gas inlet to the cold store
2.—Cold store
3.—Pump for gel
4.—Gel outlet tube to ice-tray
5.—Gel return tube
6.—Rack for ice-tray gate opening and closing
7.—Gear motor
8.—Support of the ice-tray gate
9.—Heater ring
10.—Ice ultrasound or infrared temperature detector
11.—Dispenser for liquids, water or liquid mixture
12.—Dispenser structural support
13.—Ice-tray
14.—Ice-tray gate
15.—Cold store drain
16.—Compressor
17.—Water inlet
18.—PLC
19.—Ice cube storage bin
20.—Condenser
21.—Cell
22.—Plug connection

DESCRIPTION OF A PREFERRED MODE FOR CARRYING OUT THE INVENTION

Described below is a preferred mode for carrying out the invention, which is only one of multiple modes of construction that can be carried out in the technical development of the invention.

A preferred mode for carrying out the rapid ice cube freezing device object of this invention is constituted from a parallelepiped housing that houses at its base a conventional condenser (20) and compressor (16), and on these, a cold store (2) on the right and an ice cube storage bin (19) on the left, the first consisting of a rectangular sheet metal enclosure, where the cold produced is maintained at a constant thermostatically controlled temperature of −30° C. Within said cold store (2) is a coil for liquid gel, which absorbs the ambient cold and being maintained also at a constant temperature of −30° C. A pump (3) coupled to the coil outlet pumps the gel through an upward conduct (4) until arriving to the ice-tray, where it runs into the spaces separating the cells in which cubes are formed, and then returns via a downward conduit (5) to the cooling coil continuing the cycle. A series of liquid dispensers (11) attached in line to its structural support (12) meter out the necessary water until filling each one of the cells (21) that form the ice-tray (13) and, once filled, a freezing process starts by contact of their walls of high conductive material with the cooling gel, the freezing process taking about 7 minutes. An ultrasound or infrared temperature detector (10) detects the moment in which the ice cubes reach the set temperature, in which moment a heater ring (9) is activated that heats the walls of each cell (21) until the frozen cube can come off of the walls of the cell (21) and go down when the lower gate (14) of the ice-tray (13) that swings just at that moment about a hinge axis situated in its support (8) at one end of the ice-tray (13), which is automatically operated by a gear motor (7). By the swinging the gate (14), the base of the cell (21) remains free. The top side of said gate (14) presents bas-reliefs of distinctive signs at regular spaces matching with the cube base, which may be initials of trademarks or others, which are engraved at the base of the cube. Once opened the gate (14), the ice cubes fall and slide down the ramp formed by the same opened gate to the cube storage bin (19).

A PLC (18) controls the operation and maintenance of the device by detecting and controlling lack of water
low temperature at cold store
opening and closing of the ice-tray gate
ice storage bin full
cube finished at the set temperature
failure in the pump for liquids
failure in the gear motor

The invention claimed is:

1. Method of rapid freezing ice cubes, comprising the following steps:

a) Cold is produced through a conventional condenser and compressor of low power consumption and is brought to an enclosure in stainless steel, called cold store, until reaching a temperature of −30° C., maintaining said temperature constant;

b) By means of a forcing pump; a coolant liquid gel at −30° C. is pumped from a cooling coil located inside of said cold store, through an upward conduit, running into spaces between the cells where the cubes are formed in an ice-tray, then returns to a downward conduit again to the cold store, continuing the cycle;

c) Water for refilling each of the cells forming the ice-tray is dispensed through a number of liquid dispensers attached in line to a structural support of the liquid dispensers;

d) A delay of 5 to 10 minute is allowed to lapse, depending on a cube sizes, until the water contained in each of said cells of highly conductive material cools through walls' contact with the gel, with an ultrasonic or infrared temperature detector detecting the ice has reached a set temperature;

e) A heater ring, which heats each cube until it can come off the walls of the cell, is activated;

f) A lower ice-tray gate swings about a hinge axis starting a gear motor, thereby releasing a base or bottom cover of the cells so far covered by said gate;

g) Upon release of a cell lower cover, an ice cube falls by presenting on an underside of the ice cube a distinctive sign or word initial engraved, which an upper side of said gate presents in bas-relief regularly spaced and coinciding with the base of the cells; and h) Ice cubes slide down a ramp formed by said opened gate to a cube storage bin.

2. The method of claim 1, wherein the ice cubes can be an organic product made without wasting a single drop of water, and produced both with mineral water and normal or flavoured water.

3. The method of claim 1, wherein the ice cubes are for use of upscale hotel restaurants, catering, haute-cuisine and quality ice-cream shops.

4. Rapid ice cube freezing device which comprises a housing that houses at a base of the housing a condenser and compressor, is a cold store on a right and an ice cube storage bin on a left, said cold store consisting of a stainless steel enclosure where cold produced at a constant temperature of −30° C. is maintained, and said cold store is a coil and a gel that absorbs cold from ambient air by being also maintained at a constant temperature of −30° C., a forcing pump pumping said gel through an upward conduit until reaching an ice-tray, wherein the gel runs into spaces separating cells where the cubes are formed in order then to return via a downward conduit to a cooling coil continuing a cycle, and a number of liquid dispensers attached in line to the structural support of the liquid dispensers meter out water until reaching an amount of each of the cells that form the ice-tray and, once filled, a freezing process starts by contact of walls of the cells of high conductive material with a cooling gel, the freezing process taking between 5 and 10 minutes, depending on size of the cube.

5. The rapid ice cube freezing device, according to claim 4, further comprises an ultrasound or infrared temperature detector detects when the ice cubes reach a set temperature, activating a heater ring that heats each frozen cube until each frozen cube can come off of the walls of the cell and go down when a lower gate of the ice-tray that swings about a hinge axis situated at one end of the ice-tray, which is automatically operated by a gear motor.

6. The rapid ice cube freezing device according to claim 5, wherein a gate swings, a cell base is released, wherein a top side of the gate may have a bas-relief of distinctive signs at regular spaces matching with a cube base, which may be initials of trademarks or others, which are engraved at the base of the cube; once opened the gate, the ice cubes fall and slide down a ramp formed by the same opened gate to the cube storage bin.

7. The rapid ice cube freezing device according to claim 5, further comprises a programmable logic controller, PLC, controls an operation and maintenance of the device by detecting and controlling lack of water
low temperature at cold store
opening and closing of the ice-tray gate
ice storage bin full
cube finished at the set temperature
failure in the pump for liquids
failure in the gear motor
failure in dosing and dispensing
failure in compressor and evaporator
inlet water temperature
failure in defrosting heaters
power failure alarm
ceasing of the operation at the opening of the housing panels.

8. The rapid ice cube freezing device according to claim 4, wherein a gate swings, a cell base is released, wherein a top side of the gate may have a bas-relief of distinctive signs at regular spaces matching with a cube base, which may be initials of trademarks or others, which are engraved at the base of the cube, once opened the gate, the ice cubes fall and slide down a ramp formed by the same opened gate to the cube storage bin.

9. The rapid ice cube freezing device according to claim 8, further comprises a programmable logic controller, PLC, controls an operation and maintenance of the device by detecting and controlling lack of water
low temperature at cold store
opening and closing of the ice-tray gate
ice storage bin full
cube finished at the set temperature
failure in the pump for liquids
failure in the gear motor
failure in dosing and dispensing
failure in compressor and evaporator
inlet water temperature
failure in defrosting heaters
power failure alarm
ceasing of the operation at the opening of the housing panels.

10. The rapid ice cube freezing device according to claim 4, further comprises a programmable logic controller, PLC, controls an operation and maintenance of the device by detecting and controlling lack of water
low temperature at cold store
opening and closing of the ice-tray gate
ice storage bin full
cube finished at the set temperature
failure in the pump for liquids
failure in the gear motor
failure in dosing and dispensing
failure in compressor and evaporator
inlet water temperature
failure in defrosting heaters
power failure alarm
ceasing of the operation at the opening of the housing panels.

11. The rapid ice cube freezing according to claim 4, further comprises a gas coil used in the ice-tray.

12. The rapid frozen ice cube according to claim 4, wherein the ice cube is an organic product made without wasting a single drop of water, and produced both with mineral water and normal or flavoured water.

13. The rapid frozen ice cube according to claim 4, wherein the ice cube is for use of ice cubes upscale-hotel restaurants, catering, haute-cuisine and quality ice-cream shops.

* * * * *